United States Patent [19]

Scarfo et al.

[11] Patent Number: 4,627,376

[45] Date of Patent: Dec. 9, 1986

[54] WATERCRAFT PROVIDED WITH TRIM STABILIZERS UTILIZING DIFFERENT FLUIDS

[76] Inventors: Corrado Scarfo; Paolo Scarfo, both of Via Bevagna 68, Roma, Italy

[21] Appl. No.: 729,666

[22] Filed: May 2, 1985

Related U.S. Application Data

[63] Continuation of Ser. No. 419,190, Sep. 17, 1982, abandoned.

[30] Foreign Application Priority Data

Sep. 21, 1981 [IT] Italy ..... 49332 A/81

[51] Int. Cl.[4] ..... B63B 1/16

[52] U.S. Cl. ..... 114/272; 144/273

[58] Field of Search ..... 114/271, 272, 273, 274, 114/126; 244/105, 106

[56] References Cited

U.S. PATENT DOCUMENTS

| | | | |
|---|---|---|---|
| 904,465 | 11/1908 | Thompson | 114/274 |
| 1,333,799 | 3/1920 | Doney | 114/272 |
| 1,567,139 | 12/1925 | Hartvig | 114/274 |
| 2,804,038 | 8/1957 | Barkla | 114/272 |
| 2,942,810 | 6/1960 | Hanning-Lee | 114/274 |
| 3,149,600 | 9/1964 | Traksel | 114/274 |
| 3,693,570 | 9/1972 | Erlykin | 114/274 |
| 3,738,598 | 6/1973 | Larkin | 114/272 |
| 3,768,429 | 10/1973 | Greer | 114/274 |
| 4,048,939 | 9/1977 | Jones | 114/274 |
| 4,095,549 | 6/1978 | Williams | 114/273 |

*Primary Examiner*—Trygve M. Blix
*Assistant Examiner*—C. T. Bartz
*Attorney, Agent, or Firm*—Watson, Cole, Grindle & Watson

[57] ABSTRACT

Disclosed is a watercraft in which the stabilizer for the longitudinal attitude is formed of one or more hydrodynamic wings arranged by the keel, continuous or discontinuous, running from the bow to the stern, and the stabilizer of the transverse attitude is formed by one or more aerodynamic wings, the hydrodynamic and the aerodynamic wings preferably being retractable. The stabilization wings for the transverse attitude may, in the case of light hulls, be integral with the hull, which presents a biconvex outline which is asymmetrical, with the more elevated portion having a larger curvature.

2 Claims, 9 Drawing Figures

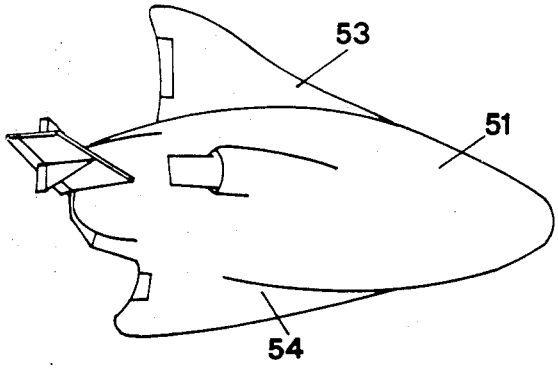
FIG 5
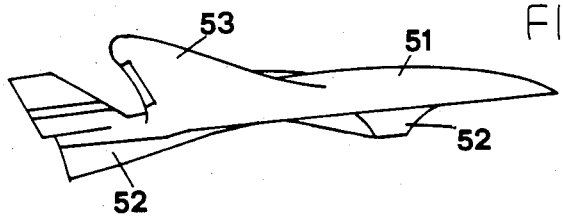
FIG 6
FIG 9
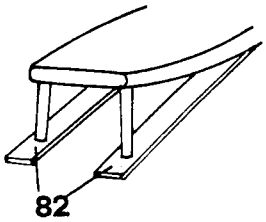
FIG 7
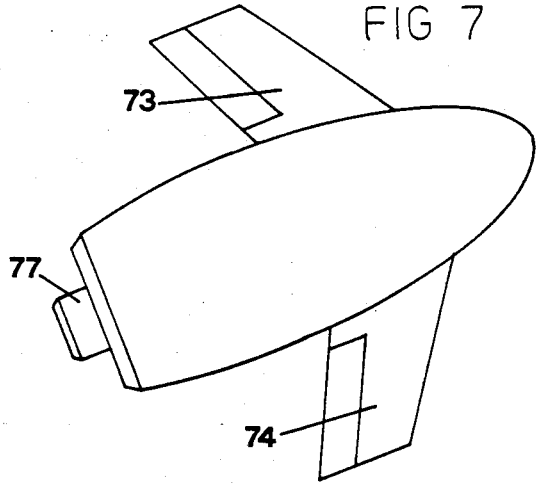
FIG 8
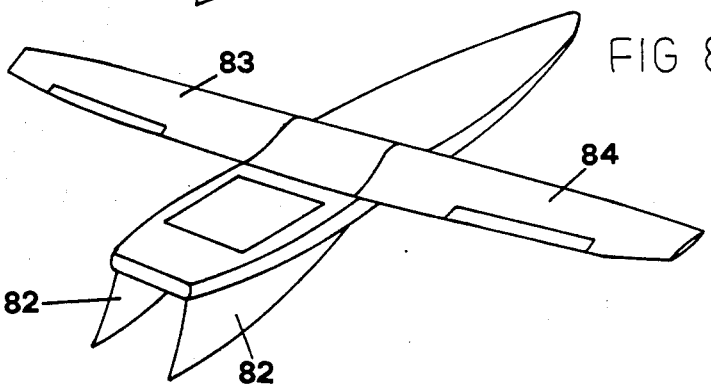

WATERCRAFT PROVIDED WITH TRIM STABILIZERS UTILIZING DIFFERENT FLUIDS

This application is a continuation application of application Ser. No. 419,190, filed Sept. 17, 1982, now abandoned.

STATE OF THE ART

It can be demonstrated with an excessive synthesis that the resistance of a body in water increases in proportion with the cube of the velocity, whereas the resistance of a body in the air increases in proportion with the square of the velocity.

It is known that the velocity in the water, with bottoms (hulls) having a conventional shape, costs a great deal in terms of power, with a progression which soon becomes prohibitive for the extremely high velocities.

The total resistance against the movement in the water is for the largest part composed of the friction resistance exerted by the particles of the liquid which lap on the surface of the bottom, and the resistance due to the formation of the waves. Such a resistance is tied to a certain ratio:velocity (V) expressed in knots and length (L) expressed in feet. It is known that this ratio is optimum when the ratio is:

$$V/\sqrt{L} = 1.$$

The designer is strictly tied by this ratio and with all the consequences deriving from it.

At the beginning of this century (indeed with some anticipations at the end of the preceding century), the hydrofoil speedboat was developed which marked the beginning of a close struggle against the resistance in the water when the velocity is high.

Today, as all the existing technologies are exploited, obviously the technologies pertaining to the aviation field are included in the sector of high-resistance, very light materials and automation systems.

Besides the development of the hydrofoil speedboat, it must also be considered the realization of the gliding crafts, in which the shape of the hull tends to take some of the properties of the lower band of a wing.

In addition, the hovercraft must be considered, whose birth goes back to some decades ago, but whose true consideration refers to the first Cockerell patent of year 1955. As it is known, the hovercraft is a craft which floats upon an air layer which is mechanically intaken (by means of fans) from the ambient air, is blown in under the hull and is kept there by a "tunic" made of a special material. Resting upon such a cushion, the craft is elevated from direct contact with the water, thus avoiding all the problems connected with the resistance against motion in the water. Driven by an aerial propeller which may also be utilized in order to blow in air for the formation of the cushion or by an underwater propeller, the craft can reach remarkable speeds.

Finally, the surface effects ships (S.E.S.) should be considered, which vary with respect to the hovercraft in the fact that, along the line of the major axis of the craft, the air layer is circumscribed by stiff walls.

It is recognized that in an ambient so variable, difficult and tormented as the marine ambient is (an ambient subjected to the winds regimen, to the characteristic of the waves—swell, wave of a short length, "seas", dangerous breakers, subjected to the ocean currents, along the coast to the countercurrents, to the regimen of the soundings—which exert an influence, when the soundings are shallow, braking the hollow portion of the wave; subjected the formation of the breakers), in such a difficult a surrounding, evey type of consideration has its qualifications and its limits, also with reference to the dimensions. For instance, the gliding crafts have a tendency towards a lesser stability, a higher sensitivity to the variation of weights, a higher subjection to make leeway, the possibility to totally exploit the power of the engine only in calm waters.

The crafts having a V-shaped bottom of the cutting gliding type (conceived in 1981 by the Northamerican R. Hunt) eliminate the flat bottom and, therefore, the drawback of "beating" when meeting the waves, by the adoption of a system of longitudinal steps on the bottom, curved as skis towards the bow, which allows the craft at full speed to raise along its whole length and to plough the waves instead of beating them, this being possible only in relatively rough sea.

Variants to the Hunt system are able to extend but not to eliminate the limits.

The hydrofoil speedboats, if they are of a small size (speedboats for sport or sport-related uses) have a relatively modest seaworthiness, e.g., a craft having a 6-meter length is not able to easily face waves higher than 20 and 30 cm.

There is, then, the problem of obstacles and it has been pointed out that a small obstruction, soft and resilient, which would wind upon the wing in the immersed portion and would cause the immediate and violent stoppage of the craft. There is, also, the problem of costs for what concerns the solution based upon retractable wings. Furthermore, the returning movements for stabilization are sharp and rough.

These are probably the reasons why the hydrofoil speedboats have not presented an important development in the sport and tourist fields.

In the large-size hydrofoil speedboats, which, incidentally, are able to better withstand the costs for the size reduction through the employment of retractable wings, and then costs for the automation of the attitude (trim) in those having completely immersed wings, the future seems to be promising, owing to the elevated speeds which can be reached and the good seaworthiness of the boats. A limitation is represented by the difficulty (increasing in relation with the size) to provide the automation for the transverse and longitudinal trim in relation to the "hardness" of the water for great speeds and in relation, too, to the costs.

The limitations under which the hovercrafts suffer are understandable. Not considering the noisiness and the cost (owing to the aeronautical matrix) presented by the craft, its practicability depends on the thickness of the air cushion, in relation with the intensity of the wave motion, as well as on the fact that this craft, not having a clearance (this is the distance between the true and proper hull and the liquid surface) is obliged to follow, with some tolerance's margin, the contour of the waves which it is unable to plough, thus imposing to the an adjusment effort which, beyond a certain speed limit, may exceed the physiological resistance barrier.

Substantially, this is a craft which cannot be substituted in certain surroundings and for certain in forms of employment but is scarcely suitable for rough seas.

As far as the surface effect ships (S.E.S.) are concerned, for which studies are in progress for the employment on large tonnage crafts which the objective of achieving high speeds, one can say only that, at the moment, it is impossible to forecast which the final outcome will be.

The watercrafts must tend towards the maximum reduction of rolling and pitching, especially under conditions of heavy sea and high speed.

The object of the present invention is to provide a watercraft in which, in order to get a higher speed and a better attitude, the horizontal and longitudinal means are split and operate individually in different media or fluids. In other words, the longitudinal stabilization is achieved by means of one or more hydrodynamic surfaces arranged along the major axis of the craft, whereas the transverse stablization is obtained through at least two aerodynamnic wings arranged according to one or more transverse axes of the craft, these wings having the function of a long lever arm.

The stabilization of the longitudinal trim is, therefore, according to the invention, drastically separated from the transverse stabilization which is entrusted to the wings operating in the air with a long lever arm. In this manner, one obtains a smoothness and a gradual behaviour of the stabilization in a fluid medium which is easier because it is less thick, and because of the repeated lever arm, one gets a reduction of the interlocked power which is necessary for the stabilization.

Such type of transverse stabilization allows, furthermore, the employment, for the hydrodynamic lift, and for the longitudinal trim, of even a single, long and narrow wing, preferably going from bow to stern (with a continuous or interrupted outline).

It is clear, furthermore, that since the longitudinal arrangement by keel of the hydrodynamic wing in combination with the stabilizing effect of the long lever's arm of the wing is a qualifying one, the variability of the shape of the wing itself is unimportant with respect of the inventive principle, and the configuration of the wing, for instance, may, for efficiency reasons, be composed of a series of small wings keyed on a bearing axis. Thus, also unimportant is the arrangement of the hydrodynamic wings by keel, both in a single row and in more rows, or in a single row in a sector and more rows in another sector. The hull, furthermore, may participate in the longitudinal trim as well as in the hydrodynamic lift (for instance with a keel having inclined planes) and this when, in the large dimensions, the hull is not intended to overhang the water.

In every case, it is useful, according to the invention, that the hydrodynamic surfaces be decreased starting from the maximum immersion in order to render the pitching movements more smooth.

In order to better illustrate the advantages offered by the hydrodynamic wing by keel, the longitudinal arrangement allows the wing to reach a larger depth, with the benefits that the seaworthiness will be better and the waves are cut by a larger blade, without being subjected to their outline, and thus the craft is in condition to better "basculate".

Furthermore, said wing, connected with a latticework to the immersed hull, almost constitutes a strong "bridge structure" which allows the hull to be extended. The advantage of the lengthening consists in that the ratio length-of-the-wave/length-of-the-ship becomes better and, therefore, the seaworthiness will be better because the pitching period will increase. It is clear, furthermore, that the longitudinal arrangement will render more easy the solution of the problem of the rectractility of the hydrodynamic wing; for instance, said wing may be fixed at an end to a fulcrum and at the other end it may be fixed through an articulated joint, controlled by an oleodynamic piston.

The invention is to be considered in relation to a wide range of tonnages, and, keeping in mind that the weight of a ship generally increases approximately in proportion with the cube of the length, it follows that, for the large tonnages, the lever-arm wing prevalingly takes the stabilizing function, whereas, for the small tonnages, said wing takes also the function of an aerial lift which is added to the hydrodynamic lift. Always keeping in account the indicated ratio/length weight, it follows that small or very small crafts are extremely light, and, therefore, the idea is spontaneous to have the hull with a suitable construction to participate in the same aerial lift, and this so more because, in order to better withdstand the impact with the water, said hulls are constructed in such a way to have a preferably enlarged plan section. In order to get the hull to participate in the lift, the hull must tend towards an asymmetrical biconvex outline, with the elevated portion having more camber in accordance with Bernoulli's principle.

The higher speed which can be reached by small crafts in relation to the strong additional aerial light provides the idea to allow these hulls to effect small aerial excursions suited to the available wing surface and to the power of the engine, in an imitation of the excursions (movements) which are effected by flying fish.

The invention will be better understood from the detailed description which follows, which is given with reference to the attached schematic drawings, in which some of the embodiments of the invention are illustrated.

In said drawings:

FIGS. 5 and 6 show a variant in which the transversal stabilizing means melt, i.e., merge with the hull as it widens and takes an asymmetrical biconvex outline;

FIG. 7 schemicatically shows a stabilized watercraft, which is longitudinally stabilized by an air cushion having a support function and placed longitudinally; and FIGS. 8 and 9 show, from the bow side, a watercraft provided with two hydrodynamic wings for a longitudinal stabilization arranged towards the bow.

Figure 1:
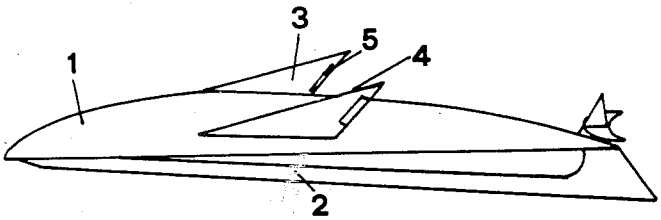
FIGS. 1, 2, 3 and 4 show some embodiments of the stabilizing means according to the invention.
Figure 2:
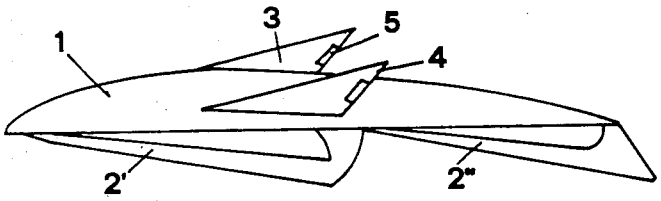

With reference to the drawings, and in particular to FIGS. 1 and 2, the longitudinal stabilization means of a watercraft 1 is constituted by a hydrodynamic wing 2 having an asymmetrical biconvex outline with its elevated portion having the larger camber, arranged by the keel, whereas the transversal stabilization is provided by two aerodynamic wings 3 and 4.

As can be seen from FIG. 2, the hydrodynamic wing 2 of Fig. 1 is subdivided into two sectors 2' and 2'', in such a way to allow a better longitudinal stabilization.

Figure 3:
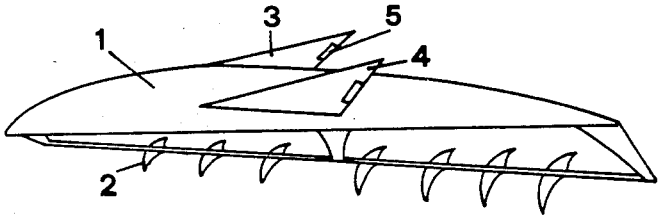

It should be pointed out that the hydrodynamic wings, as it has been previously mentioned, may be arranged by the keel along the hull 1, and/or be keyed upon supporting beams (see FIG. 3), in such a manner to permit the stabilization without having a continuous hydrodynamic wing. In the case which is illustrated in FIG. 3, the hydrodynamic wings 2 are split and have decreasing dimensions, starting from the point of maximum immersion, that is, starting from the bow. By this artifice, smoother movements of pitching can be achieved.

Figure 4:
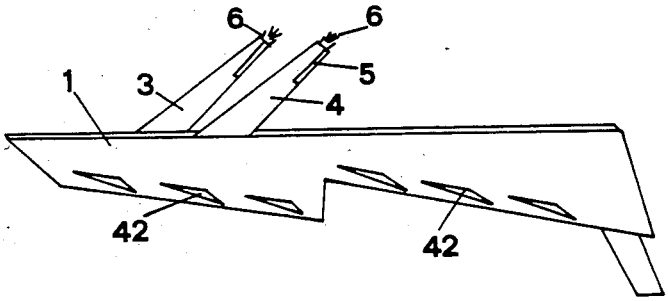

On the other hand, as illustrated in FIG. 4, the hydrodynamic wings may participate only in part in the lift of the hull. To this end, the hydrodynamic wings 42, sectioned or continuous, are arranged along the bottom, which is very sharpened, and on the two sides of it.

With reference to FIGS. 1 to 4, it should also be pointed out that the aerodynamic wings 3 and 4, used for the transverse stabilization, have a dihedral shape and are provided with ailerons 5, and other means similar to those used for aircraft, in order to facilitate the stabilization.

From FIG. 4, one can see that the aerodynamic wings 3 and 4, according to a variant of the invention, may be provided with nozzles 6 for the outflow of fluids for facilitating the transverse stabilization, these nozzles being controlled by an automated stabilization system of a known rype. The aerial wings 3 and 4, which have been previously mentioned, may be embodied, and this particularly in the case of light watercrafts, directly into the hull, and, therefore, the watercraft may take the shape which is represented in FIGS. 5 and 6, in which the transverse stabilization surfaces 53 and 54 are integral with the hull 51 of the watercraft, which takes also a bearing (lifting) function facilitated by an asymmetrical biconvex outline with the elevated portion having a larger camber (Bernoulli's principle). In this case, the transverse stabilization surfaces 53 are, preferably, carried towards the stern, whereas the longitudinal stabilization means 52 are situated in the manner which has been previously indicated.

Lastly, one solution is illustrated in FIGS. 8 and 9, in which the watercraft is provided, on the stern side, with two longitudinal stabilization wings 82, arranged parallel to each other and connected with the transom; said wings 82 having the function of longitudinal stabilization. Also, in the case of FIGS. 8 and 9, means for transverse stabilization are provided by aerodynamic wings 83,84.

The existence, on the other hand, is known of means, such as in the hovercrafts, which are supported by an air cushion. In this craft, as illustrated in FIG. 7, the air cushion 77 is intended for the longitudinal stabilization and will be preferably narrowed and arranged by the keel, so that it will perform the same function which had been assigned to the hydrodynamic wing 2 which has been seen in the embodiments illustrated in FIGS. 1 and 2. Also in this case, obviously, the transverse stabilization is accomplished by means of aerodynamic wings 75 and 74.

As it has been previously mentioned, due to the action of a propelling means, not shown in the figure, the transversal stabilizing surfaces 3,4, 53,54, and so on, will also perform an aerodynamically lifting function, more or less conspicuous, in function of the dimensions of the watercraft itself. As stated previously, it is known that the weight of a watercraft increases in proportion with the cube of the length, so that, for watercrafts of a certain tonnage, it is not convenient to adopt aerodynamic surface which would be suited to the aerodynamic wing resistance, but to those surfaces the prevailing and determining function is assigned of the transverse stabilization. It is evident, however, that, in every case, said surfaces will also perform a lifting function or role which, if the surfaces themselves are suitably arranged and sized, may tend to lighten the bow leading, in analogy with the functions performed by the jib, flying jib and fore topmast stay sails in sailing ships.

From the above, it follows, by reverse deduction, that, in the watercraft has a relatively small size, and the transverse stabilization surface is sufficient, it is possible, by means of a propelling means, to impress to the watercraft a speed which allows the watercraft itself to take off and to cover a more or less long distance under conditions of movement in the air, in the manner of a flying fish.

It is, however, to be observed that the present invention does not refer to a mobile moving in the air but to a watercraft which, once it has reached a certain speed, may effect some short glidings in order to come back to the natural element, in similarity to the case of the flying fish. The propelling means must, obviously, be cut off at the moment in which the craft leaves the water, and the means will be restarted when the craft comes back to the water. This solution is intended for mainly sport purposes, that is, in order to allow the navigator feel the elation of effecting relatively short runs out of the contact with the water.

Similarly, for sport purposes, the watercraft may be formed of one or more boards of the type employed for surfing, the boards always having a biconvex outline, as previously stated, the board(s) being provided with the above-indicated stabilization means and with a suitable propelling means. Evidently, in this case also, the aerodynamic wings may be integral with the board, as in the case of the watercraft illustrated in FIGS. 5 and 6.

In the invention, it is also contemplated that the transverse stabilization surfaces which react with the air may also be provided with fans, variable speed screw propellers, or ejectors, which will emit fluid in an amount and at a pressure sufficient to effect the stabilization operation or also to increase that function, keeping in mind that the large arm, with which the transverse stabilization member acts, reduces the energy which is necessary to the stabilization itself. Preferably, said stabilization means must be interlocked with an automated means of the type which are employed in aircraft, preferably on a gyroscopic basis.

We claim:

1. A watercraft having attitude stabilizing members utilizing different fluids, said watercraft comprising a hull with a bow and a stern and having a longitudinal axis, a beam having a longitudinal axis located beneath the hull and extending along the length of the hull, the longitudinal axis of the beam being in a plane with the longitudinal axis of the hull and non-parallel thereto, the two axes intersecting adjacent the bow of the boat, a first stabilizing member which effects longitudinal attitude stabilization by contact with water, said first stabilizing member comprising at least three narrow hydrodynamic wings attached in a row along the length of the beam, the largest dimension of the wings being transverse to the longitudinal axis of the beam and extending on both sides thereof, the wings being of differing surface areas with the wing having the largest surface area being nearest the stern and with the wing having the smallest surface area being nearest the bow, and two second attitude stabilizing members attached to the hull and extending generally upwardly so as to effect transverse stabilization by contact with air, the second attitude stabilizing members each comprising an aerial wing having a controllable aileron, the outward ends of each of the aerial wings having means for emitting a fluid in an amount and at a pressure sufficient to help effect stabilization.

2. A watercraft in accordance with claim 1, wherein the means for emitting a fluid is an ejector nozzle.

* * * * *